US005081715A

United States Patent [19]

Mascia

[11] Patent Number: 5,081,715

[45] Date of Patent: Jan. 21, 1992

[54] PALM PROTECTOR

[76] Inventor: Michael F. Mascia, R.R. #1 Box 229 A, Bridgeton, Me. 04009

[21] Appl. No.: 362,568

[22] Filed: Jun. 7, 1989

[51] Int. Cl.[5] ..... A41D 13/08

[52] U.S. Cl. ..... 2/20; 2/DIG. 6

[58] Field of Search ..... 2/16, 19, 20, 159, 160, 2/161 R, 161 A, 164, 170, DIG. 6, 168, ; 15/227; 273/166

[56] References Cited

U.S. PATENT DOCUMENTS

| | | | |
|---|---|---|---|
| 1,797,116 | 3/1931 | Barden | 2/19 |
| 3,583,704 | 6/1971 | Callahan | 2/161 A X |
| 4,270,228 | 3/1980 | Pattton, Jr. | 2/161 A |
| 4,617,684 | 10/1986 | Green | 2/19 X |
| 4,754,499 | 7/1988 | Pirie | 2/20 |

FOREIGN PATENT DOCUMENTS

| | | | |
|---|---|---|---|
| 0148604 | 6/1981 | Fed. Rep. of Germany | 2/167 |

OTHER PUBLICATIONS

*Velcro Product News*, PN. No. 46, Jun. 1978.

*Primary Examiner*—Warner H. Schroeder
*Assistant Examiner*—Sara M. Current
*Attorney, Agent, or Firm*—Cesari and McKenna

[57] ABSTRACT

A protective pad assembly especially shaped to fit over the palm of the hand to protect the median nerve. A pair of straps extend in opposite directions from opposite edges of the patch and can be folded behind the hand to hold the patch against the palm. One or more flexible resilient pad units are positioned flush against and in register with the patch. Fastener means are provided on the opposing faces of the patch and pad units for releasably securing those elements in face-to-face contact so that they form a compact sandwich structure.

10 Claims, 1 Drawing Sheet

PALM PROTECTOR

This invention relates to an article in the nature of a for removably covering the palm of the hand to protect area from abrasion, impacts and other shock forces capable of producing trauma to the hand.

BACKGROUND OF THE INVENTION

The palm of one's hand can be subjected to significant trauma when one engages in certain physical activity such as bicycle riding, weight lifting, shoveling, etc. involving gripping by the hand. Shock forces are transmitted through the article being held to the hand, especially the palm of the hand. Within the proximal palm is the median nerve. This nerve is particularly vulnerable to trauma within the flexor retinaculum of the palm.

Various types of gloves and pad devices do exist for covering the hand during such activities. For example, U.S. Pat. No. 3,896,498 discloses a palm guard for covering only part of the palm of the user. Some prior gloves and hand guards are provided with shock absorbing materials such as foam rubber, quilting or nap over part or all of their surface areas to provide extra insulation and buffering. See, for example, U.S. Pat. Nos. 3,173,150; 3,598,408 3,363,265; 4,176,407; 4,183,100; 4,691,387 and 4,590,625. In some cases, the extra padding is releasable from the basic glove structure so that the characteristics of the gloves can be varied to suit the user's particular activity. Examples of protective gloves of this type are disclosed in U.S. Pat. Nos. 3,885,249; 3,994,025 and 4,042,975. While these prior conventional gloves and pads do provide some protection to the hand, they do not offer sufficient protection to the median nerve. As a result, the user may suffer numbness of the thumb, index and third fingers (known as carpel tunnel syndrome) and/or other soft tissue injuries at the base of the thumb following biking, shoveling, or other such activity involving strenuous use of the hand.

SUMMARY OF THE INVENTION

Accordingly, it is an object of the present invention to provide a protective device designed especially to absorb shock forces and, therefore, to reduce the chances of skin, nerve, muscle or tendon damage.

Another object of the invention is to provide a protective device of this type whose shock absorbing characteristics can be varied depending upon the shock forces likely to be encountered by the user.

A further object in the invention is to provide such a device in the form of a palm protector which can be accommodated to a wide range of hand sizes and shapes.

Yet another object of the invention is to provide a palm protector which does not interfere with the normal flexing and gripping movements of the hand.

Still another object of the invention is to provide a device of this type which can be worn under or over a conventional glove or mitten.

Another object of the invention is to provide a palm protector which is relatively inexpensive to make in quantity.

Other objects will, in part, be obvious and will, in part, appear hereinafter. The invention accordingly comprises the features of construction, combination of elements and the arrangement of parts which will be exemplified in the following detailed description, in the scope of the invention will be indicated in the claims.

Briefly, the protective device to be described herein is designed to protectively cover the palm of the hand. However, it should be understood that certain aspects of the device have application to pads for protecting other areas of the body, such as the knee, chest and perineum. Thus, the device can be custom designed and/or modified to attach to and protect other body parts, e.g. incorporated into a jacket or vest to protect the chest wall, or to attach to athletic equipment and tools to protect various body parts, e.g. mounted to a bicycle seat to protect the posterior or in a shoe to protect the heel of the foot.

The palm protector incorporating my invention is in the form of a plural-layer pad assembly that extends continuously over the surface of the palm from the palmar crease, over the portion of the deep palmer arch from the thenar eminence to the hypothenar muscle group, to the base of the palm where the palm joins the wrist. The pad assembly extends width-wise from the edge of the hand to the distal phalanx of the thumb. Integral straps are provided at the upper side edge margins of the pad assembly. Fasteners are provided at the free ends of those straps so that the straps can be wrapped around the sides of the palm and secured together at the back of the hand to hold the pad assembly in place. Similar straps may be provided at the lower end of the assembly to releasably secure that end to the wearer's wrist. The palm protector is quite thin and hugs the wearer's hand so that a conventional glove or mitten can be worn over the palm protector to protect the wearer's fingers and thumb and to keep the hand warm in the event that it becomes desirable or necessary to do so.

The assembly is composed of a plurality of coextensive, flexible and compressible material layers secured together face-to-face. The first layer is a base layer made of non-stretchable material such as woven cloth fabric which maintains the basic shape of the palm protector. A layer of terry cloth or other such moisture-absorbing fabric is adhered or laminated to the underside of the base layer to provide a palm-engaging surface which is soft, comfortable and washable and which will absorb any moisture present on the wearer's palm.

Releasably secured to the upper or outer surface of the base layer is an outer pad made of flexible resilient material, e.g. a Neoprene foam sheet. Cooperating fasteners are provided on the opposing surfaces of the base layer and outer pad to releasably secure the outer pad to the base layer. One or more inner pads may be provided and custom cut to fit between the outer pad and the base layer, with each such inner pad being provided with fasteners on its opposite surfaces which cooperate with the fasteners on the base layer and outer pad, respectively, so that all of the pads are securely, but releasably, connected to the base layer of the palm protector.

The straps for securing the pad assembly to the wearer's hand may constitute lateral extensions of the base layer and terry cloth underlayer, with suitable mating fasteners being provided at the ends of those straps which can be superimposed to releasably secure the palm protector to the wearer's hand. The palm protector thus covers and protects the entire area of the proximal palm where the median nerve is located without materially reducing the flexing and gripping abilities of the palm and thumb. The shock-absorbing property of the protector can be increased as needed simply by stacking custom cut additional inner pads between the base layer and the outer pad. Even when several such pads are incorporated into the palm protector, the device retains its flexibility and ability to fit under a conventional glove or mitten worn on that hand.

The different layers of the palm protector can be formed as large sheets with the individual pads being cut by the wearer or stamped commercially from those sheets. Consequently the cost of making the palm protector can be kept to a minimum.

BRIEF DESCRIPTION OF THE DRAWING

For a fuller understanding of the nature and objects of the invention, reference should be had to the following detailed description, taken in conjunction with the accompanying drawing, in which.

DETAILED DESCRIPTION OF ILLUSTRATIVE EMBODIMENT

Figure 1:
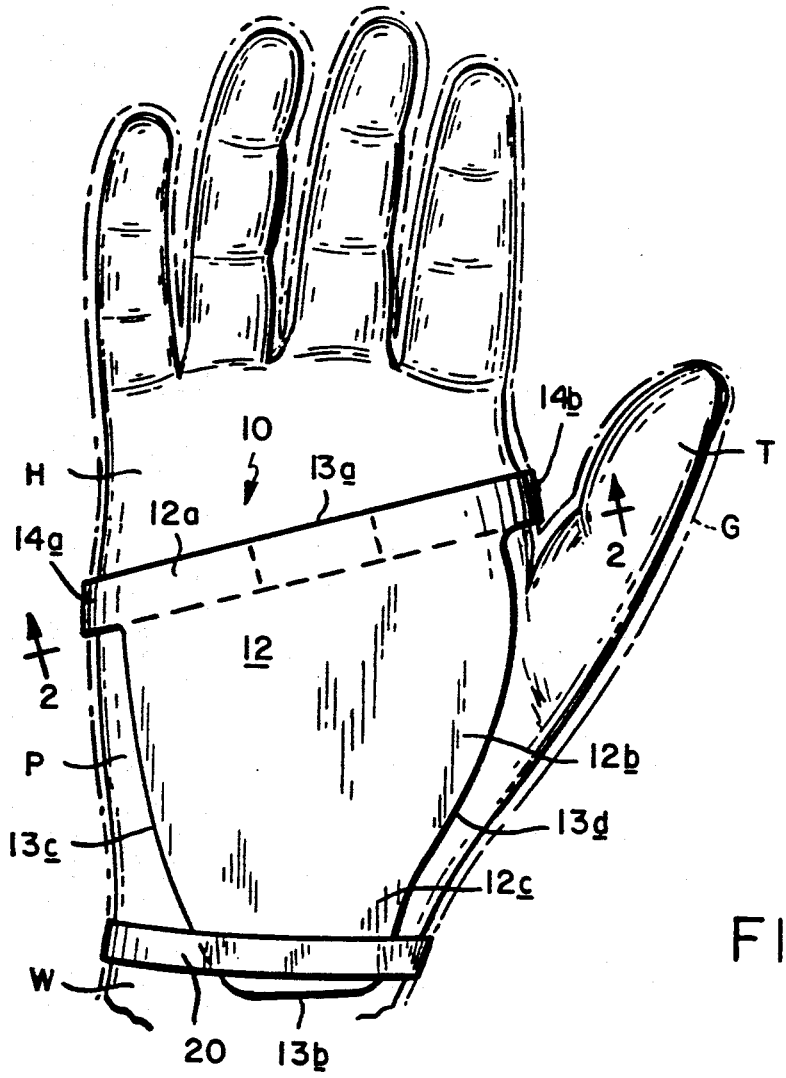
FIG. 1 is a plan view of a palm protector made in accordance with this invention.

Referring to FIG. 1 of the drawing, a palm protector, shown generally at 10, is shown releasably secured to the palm P of a user's hand H. The protector includes a plural-layer pad assembly 12 having a relatively wide upper section 12*a* that extends from the palmer crease of the hand, past the proximal transverse of the palm where it joins a narrower intermediate pad assembly section 12*b* which covers the deep palmer arch from the thenar eminence to the hypothenar muscle group. The intermediate section 12*b* extends down to the base of the palm where it joins a still narrower pad assembly section 12*c* which extends over the bottom of the hand at the wrist W.

The pad assembly 12 has an upper diagonal edge 13*a* which follows the angle of the palmar crease and a lower edge 13*b* which is more or less horizontal. The protector spans the proximal palm with one edge 13*c* of the palm following generally the contour of the rear edge of the users hand. The opposite side edge 13*d* of the assembly 12 follows the base of the wearer's thumb T so that the protector 10 overlies the distal phalanx of that user's thumb. Thus the protector covers the entire proximal palm including the portion thereof containing the flexor retinaculum of the palm and the median nerve. It also covers the soft tissue at the base of the thumb. The device 10 is shaped to fit a user's right hand; a comparable palm protector for the user's left hand consists of a mirror image of protector 10.

Figure 2:
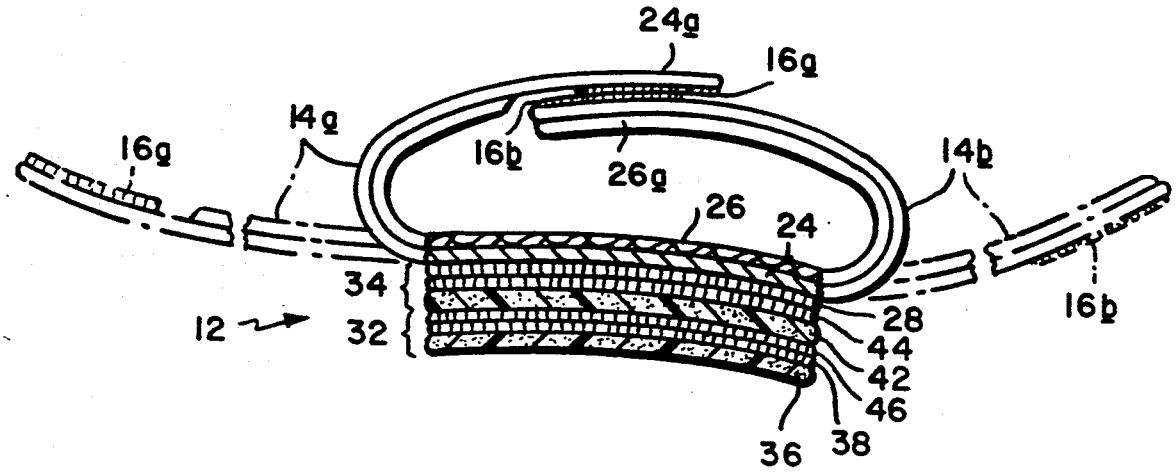
FIG. 2 is a sectional view taken along line 2—2 of FIG. 1.

Protector 10 also includes means for releasably securing pad assembly 12 to hand H. In the illustrated embodiment of the invention, the securing means comprise a pair of elongated straps 14*a* and 14*b* extending laterally from the pad assembly opposite side edges 13*c* and 13*d* at the upper end of the protector. These straps are sufficiently long such that they can be wrapped around the side edges of the hand at the deep palmar arch with their ends overlapping at the back of the hand. Cooperating fasteners 16*a* and 16*b*, apparent in FIG. 2, are provided at the ends of those straps for securing the strap ends together to retain pad assembly 12 against the palm. The pad assembly 12 lies flat against the user's palm P and, being flexible, conforms more or less to the surface topography of that palm. Accordingly, a hand wearing the protector 10 can still fit inside a standard-size glove or mitten G as shown in phantom in FIG. 1 in the event that the wearer desires to protect other parts of hand H.

In some cases, it may be desirable to secure the lower end of the pad assembly 12 to the wearer's hand, particularly when a glove G is not being worn. In the illustrated palm protector, this additional securement is provided by a flexible strap 20 similar to straps 14*a*, 14*b* which can be wrapped around the lower end section 12*c* of assembly 12 and around the wearers wrist W, with the opposite ends of strap 20 being releasably secured together by cooperating fasteners similar to fasteners 16*a* and 16*b* described above. Alternatively, the single strap 20 may be formed as two strap extensions of assembly 12 in the manner of straps 14*a* and 14*b*.

Referring now to FIG. 2, the palm protector 10 comprises a plurality of coextensive flexible material layers. In FIG. 2, the thicknesses of these layers are shown exaggerated for ease of illustration. Assembly 12 includes a base layer or patch 24 made of strong inextensible cloth material which is able to hold it's shape. Adhered or laminated to one surface of base layer 24 is a layer 26 of a soft absorbent material such as terry cloth which has a good feel when worn next to the skin. Layer 26 has a pair of extensions which are adhered to straps 14*a* and 14*b* as shown in FIG. 2. Adhered to the opposite surface of base layer 24 is a fastener layer 28 of a burring material such as that marketed by Velcro U.S.A. Inc. under the registered trademark VELCRO. For example, the layer 28 may consist of a sheet of VELCRO hook material.

The straps 14*a* and 14*b* referred to above consist of lateral integral extensions of material layers 24 and 26. The fasteners 16*a* and 16*b* at the ends of those straps may consist of patches of VELCRO hook and eye material adhered to opposite surfaces of the straps 14*a* and 14*b* as shown in FIG. 2.

Releasably secured to base layer 24 by the fastener layer 28 is a flexible resilient outer pad 32 and, optionally, one or more flexible resilient inner pads 34. Pad 32 is composed of a layer 36 of a flexible resilient material such as foam rubber. For example, layer 36 may consist of a sheet of closed cell foam material having a thickness in the order of 0.125 inch. Adhered to the surface of layer 36 facing layer 24 is a layer 38 of burring material of the type that will corporate with layer 28 to fasten pad 32 to the base layer 24. Thus in the illustrated palm protector 10, layer 38 would consist of a sheet of VELCRO eye fastener material.

In the event that the user requires only a minimum amount of palm protection, inner pad 34 can be eliminated and pad 32 fastened directly to the base layer 24 by means of the mating fastener layers 28 and 38. If, due to a the particular activity of the wearer, additional padding on the palm is desirable, one or more inner pads 34 can be interposed between the base layer 24 and the outer pad 32.

Inner pad 34 is similar to pad 32 in that it includes a relatively thick flexible, resilient layer 42 and a hook-type fastener layer 44 capable of mating with the fastener layer 28 on the base layer 24. In addition, however, pad 34 includes a third layer 46 of fastener material similar to the fastener layer 28, ie. hook material in this example, that will attach to the fastener layer 38 at the inner face of outer pad 32. Thus when all of the pads are superimposed as shown in FIG. 2, the outer pad 32 will adhere to the adjacent inner pad, the inner pads 34 will adhere to each other if more than one is present, and the innermost pad 34 will adhere to the base layer 24 forming a stable pad stack at the surface of palm P whose shock absorbing properties will be commensurate with the strength of the shock forces expected to be encountered by the wearer's hand.

To use the palm protector 10, pad 32, and perhaps one or more of the pads 34 is fastened to base layer 24 and pad 12 is placed against the proximal palm as shown in FIG. 1. Straps 14*a* and 14*b* are wrapped around the sides and back of the hand and the overlapping free ends of those straps are secured together by the fastener patches 16*a* and 16*b* as shown in solid lines in FIG. 2. When secured thusly, the palm protector is held tightly against the hand. If additional securement is necessary or is desired, the strap 20 may be engaged around the lower end of the pad and the wearer's wrists as shown in FIG. 1.

When worn thusly, the palm protector 10 covers the portions of the palm that are subjected to shock forces when the wearer engages in activities such as bicycle riding, weight lifting, shoveling and the like. Yet the protector 10 does not decrease the hand's ability to flex and grip in order to carry out those activities properly. Protector 10 is compact, lightweight and comfortable to wear. At the same time, it is relatively easy and inexpensive to make. Therefore it should find wide application wherever it is desirable to provide protection for the palm area of the hand.

We will thus be seen that the objects set forth above, among those made apparent from the preceding description, are efficiently attained. Also, certain changes may be made in the above construction without departing from the scope of the invention. For example a protector similar to device 10 can be shaped to fit a knee or elbow. Therefore, it is intended that all matter contained in the above description or shown in the accompanying drawing be interpreted as illustrative and not in a limiting sense.

It is also to be understood that the following claims are intended to cover all of the generic and specific features of the invention herein described.

We claim:

1. A protective pad assembly for protecting the palm of a hand comprising a patch of flexible and inextensible material, said patch having top, bottom and opposite side edges said patch covering only the surface of the palm from the palmar crease, over the portion of the deep palmar arch from thenar eminence to the hypothenar muscle group, to the base of the palm and the distal phalanx of the thumb;

a pair of straps extending in opposite directions from opposite edges of said patch;

cooperating means on the free ends of said straps for releasably securing together said strap free ends;

a flexible resilient pad having substantially the same dimensions as said patch so that the pad can be superimposed on said patch with their opposing surfaces in face to face contact, and coacting fastener means on the opposing faces of said patch and pad for releasably securing the pad to the patch.

2. The pad assembly defined in claim 1 wherein the coacting fastener means comprises a layer of hook material on one of said opposing faces, and a layer of eye material on the other of said opposing faces.

3. The pad assembly defined in claim 2 wherein said cooperating means comprise a layer of hook material on one face of one of said straps, and a layer of eye material on the opposite face of the other of said straps.

4. A protective pad assembly for protection of the palm of a hand comprising a patch of flexible and inextensible material, said patch having top, bottom and opposite side edges;

a pair of straps extending in opposite directions from opposite edges of said patch;

cooperating means on the free ends of said straps for releasably securing together said strap free ends;

a flexible resilient pad having substantially the same dimensions as said patch so that the pad can be superimposed on said patch with their opposing surfaces in face to face contact;

coacting fastener means on the opposing faces of said patch and pad for releasably securing the pad to the patch;

a second flexible resilient pad having the same dimensions as the first-mentioned pad so that the second pad can be positioned flush against the exposed face of the first pad, and second coacting fastener means on the opposing faces of the first and second pads for releasably fastening the second pad to the first pad.

5. The pad assembly defined in claim 4 for protecting the palm of a hand wherein said patch covers the surface of the palm from the palmar crease, over the portion of the deep palmar arch from thenar eminence to the hypothenar muscle group, to the base of the palm and the distal phalanx of the thumb.

6. The pad assembly defined in claim 4 wherein the coacting first and second fastener means comprise layers of fastener material of one type on first corresponding surfaces of said patch and first pad, and layers of fastener material of a second type that adheres to said one type material on the corresponding faces of said first and second pads.

7. The pad assembly defined in claim 6 and further including one or more releasable pad units similar to said first pad and the material layers thereon sandwiched between the patch and the second pad.

8. The pad assembly defined in claim 4 and further including a layer of soft flexible, moisture-absorbing material adhered to the surface of said patch facing away from said fastener means

9. The pad assembly defined in claim 8 and further including strap means for securing said patch to the hand, said strap means being spaced along said patch from said pair of straps.

10. The pad assembly defined in claim 8 wherein said layer of moisture-absorbing material extends over the surfaces of said pair of straps.

* * * * *